United States Patent [19]

Souders

[11] Patent Number: 4,824,386

[45] Date of Patent: Apr. 25, 1989

[54] SECURITY CONNECTOR ASSEMBLY FOR MATING COAXIAL CONNECTORS

[76] Inventor: Roger B. Souders, 10180 Eagle Rock Ave., San Diego, Calif. 92126

[21] Appl. No.: 104,403

[22] Filed: Oct. 5, 1987

[51] Int. Cl.[4] ..... H01R 13/44; H01R 13/625

[52] U.S. Cl. ..... 439/133; 439/306; 439/348; 439/583

[58] Field of Search ..... 439/18–20, 439/133, 304, 306–309, 348, 349, 893, 675, 583, 584

[56] References Cited

U.S. PATENT DOCUMENTS

| | | | |
|---|---|---|---|
| 3,237,147 | 2/1966 | Elliott et al. | 439/349 |
| 3,319,213 | 5/1967 | Mas | 439/348 |
| 3,646,502 | 2/1972 | Hutter et al. | 439/675 |
| 3,861,770 | 1/1975 | Horak | 439/133 |
| 3,888,559 | 6/1975 | Geib | 439/348 |
| 3,890,028 | 6/1975 | Blanchenot | 439/133 |
| 3,953,097 | 4/1976 | Graham | 439/307 |
| 4,037,909 | 7/1977 | Trompeter et al. | 439/584 |
| 4,053,195 | 10/1977 | Laverick et al. | 439/308 |
| 4,469,386 | 9/1984 | Ackerman | 439/133 |

*Primary Examiner*—Gil Weidenfeld
*Assistant Examiner*—P. Austin Bradley
*Attorney, Agent, or Firm*—Brown, Martin, Haller & McClain

[57] ABSTRACT

An apparatus for providing selective electrical coupling between a pair of mating coaxial connectors. The assembly includes an outer casing, an inner casing, and a sleeve therebetween. The inner casing is rotatably disposed about a common axis with the outer casing within the outer casing. The inner casing is internally threaded at one end for attaching to one of a pair of mating coaxial connectors. The sleeve is rotatably disposed about the common axis between the outer and inner casings with the sleeve and inner casing being rotatably retained with the outer casing. A pair of ball sockets are formed in the inner casing with each containing a ball therein. The sleeve has a pair of axial grooves which when aligned with the ball sockets permit the other one of the pair of mating connectors to be inserted and moved within the inner casing. When the axial grooves are offset in alignment from the ball sockets, the balls protrude into the inner casing hollow interior and retain the other mating connector in a selected one of two positions. In the two positions the other mating coaxial connector is respectively engaged and disengaged from electrical contact with the one mating connector.

23 Claims, 2 Drawing Sheets

SECURITY CONNECTOR ASSEMBLY FOR MATING COAXIAL CONNECTORS

BACKGROUND OF THE INVENTION

1. Technical Field

The present invention relates to electrical connectors. More specifically, the present invention relates to a novel tamper-resistant connector assembly for selective electrical coupling of a male coaxial connector to a female coaxial connector.

2. Background Art

Cable television distribution systems typically utilize junction boxes or directional taps at specific remote locations for distributing the signal to multiple residences or apartments. A typical directional tap may be located on a telephone pole, in a stand-alone box or a wall-box, a roof mounted box, or an underground box. Each directional tap may typically include, for example, eight separate output ports for distributing the signal transmitted to the directional tap via a distribution cable, to eight individual locations. For example, separate residence or apartment would be connected to a different output port by a separate service cable.

The directional tap output ports are typically configured as a female coaxial connector having an externally threaded body. The female connector body is electrically connected to the bus cable ground sheath. The female connector includes a center conductor socket electrically insulated from the connector body. The center conductor socket is in electrical contact with the distribution cable center conductor which carries the transmitted signal. In the typical installation, a male coaxial connector is coupled to the end of the service cable for connection to an output port. The male connector has a metal outer body with a rotating internally threaded flange which mechanically secures the male connector to the female connector. The male connector body is in electrical contact with the service cable ground sheath. The male connector also permits the service cable insulated center conductor to protrude therefrom. When the male connector is attached to the female connector the service cable center conductor is inserted into the female connector center conductor socket. When the male connector is attached to the female connector, the center conductors of both cables are electrically connected. Similarly the ground sheaths of both cables are electrically connected.

Current disconnect procedures require the installer to locate the line to be disconnected and unscrew the male service cable connector from the connected directional tap output port female connector. The disconnected line is then typically wrapped with a blue or orange tape for disconnection identification. Finally, a terminating device is mounted on the open port preventing access to the cable signal. One such type of termination device is a tamper-resistant terminator as disclosed in U.S. Pat. No. 4,469,386. In addition, in many cases, the male connector is cut from the end of the service cable to discourage unauthorized connection of cable service.

The total time in disconnecting service at a directional tap depends upon the location of the directional tap. As mentioned earlier, the directional tap may be mounted on a telephone pole, a wall-box, a roof mounted box, or an underground box. The estimated average time of disconnection of a service cable is 2 minutes and 18 seconds for all combined directional tap locations. This estimated average is a true time average for a properly labelled service cable. If the line to be terminated is not property labeled, it is estimated that approximately 49 seconds may be added to the average time for disconnection of service. The extra time results from the installer having to locate and label the service cable to be disconnected from the directional tap output port. Where extra time is required to locate and label the service cable, the total time is now approximately 3 minutes and 7 seconds.

For the installation of cable service, in a residence where a service cable is already in place but disconnected according to the above-described procedures, an installer must perform specific tasks to complete the cable service connection. First the installer needs to locate the line for connection to the directional tap. This procedure requires for the line to be found and the line labelled with the last two numbers of the address if necessary. The installer next attaches a new protective weatherboot and new male connector, if necessary, to the end of the cable line. The installer next attaches an installment month label.

The directional tap is then prepared for having the service cable connected thereto. First, an open output port must be found for connection of the service cable. The termination device is removed from the selected available output port. The output port is cleaned with a wire brush to remove any rust or debris collecting therein due to inactivity. The male connector is then screwed onto the output port female connector and tightened with a wrench. The protective weatherboot is then packed with a silicone gel and pushed flush with the directional tap for a water-proof fit. Upon completion of these tasks, the connection of cable service is now completed. The total average estimated time for all types of directional tap locations to complete the installation process is approximately 4 minutes and 28 seconds.

It is, therefore, an object of the present invention to provide a new and improved secure, tamper-resistant connector for selective connection and disconnection of cable service at a directional tap.

SUMMARY OF THE INVENTION

The present invention consists of a connector assembly for mounting upon a directional tap output port in combination with a mating connector which is selectively positioned within the connector assembly for connection or disconnection of cable service. The connector assembly is of a tamper-resistant construction to prevent unauthorized connection of service. The connector assembly is coupled to a directional tap port typically an externally threaded female coaxial connector having a center conductor socket. The connector assembly provides selective electrical coupling of a male mating coaxial connector to the directional tap female connector.

The assembly includes a hollow cylindrical outer casing having an inner annular groove adjacent one end and an inner shoulder adjacent the other end. A hollow cylindrical sleeve is rotatably disposed about a common axis with the outer casing within said outer casing. The sleeve has one end with a pair of radially opposed inner axial grooves with the sleeve one end abuts the outer casing inner shoulder.

A hollow cylindrical inner casing is rotatably disposed about the common axis within the sleeve with the inner casing having a flange at one end. The inner casing is internally threaded at the flange end for engaging the directional tap female connector The other end of the sleeve abuts the inner casing flange. The inner casing has a pair of radially opposed ball sockets formed therein with a ball mounted in each ball socket. A retaining ring is mounted within the outer casing groove and engaging the end face of the inner casing flange.

The male mating connector includes a hollow cylindrical coupling casing having a pair of spaced-apart outer annular grooves. One of the grooves is located adjacent the mating end of the male connector. The coupling casing receives a coaxial cable through the other end of the coupling casing with the cable center conductor extending beyond the mating end of the coupling casing.

The mating connector is inserted into the assembly inner casing hollow interior for locking engagement therein when the sleeve axial grooves are positioned in alignment with the inner casing wall sockets. The balls lockingly engage a selected one of the coupling casing grooves when the sleeve axial grooves are rotated for an offset in alignment of the sleeve grooves with the ball sockets. The balls disengage the male connector groove when the sleeve axial grooves are aligned with the ball sockets. With the balls engaged in the groove adjacent the mating end of the coupling casing, the service cable center conductor is disengaged from the directional tap female connector center conductor socket. When positioned with the groove adjacent the mating connector end receiving the cable, the cable center conductor is engaged with the directional tap female connector center conductor socket. In the latter position, service is connected since there is electrical continuity between the distribution cable and service cable via the connector assembly and directional tap.

To connect or disconnect service, a special tool is inserted in a gap between the inner and outer casing. The tool engages the sleeve and permits rotation of the sleeve in aligning or offsetting the sleeve axial grooves from the ball sockets. The use of the tool enables tamper-proof positioning of the coupling casing in a selected position for service connection or disconnection. The connector assembly locks the mating connector in a selected service connection or disconnection position within the inner casing housing. Once service is established and the connector assembly installed, the mating connector need not be removed from the connector assembly to discontinue service.

Using the device of the present invention, service disconnect and connect time can be lowered to an average of approximately 1 minute and 11 seconds per line. This estimate includes climbing time and any additional ladder work if necessary. Since all cable lines with the device in place will be properly labelled, the true time estimate will have little variation.

The disconnect procedure will simply require one to unlock the mating connector with the special tool, reposition the mating connector within the connector assembly and relock the mating connector with the tool. By utilizing the connector assembly of the present invention, the female and male connectors are not touched by human hand and are environmentally protected from corrosion and other contaminants.

BRIEF DESCRIPTION OF THE DRAWINGS

These and other features, objects, and advantages of the invention will be more fully apparent from the detailed description set forth below taken in conjunction with the drawings in which like reference characters identify correspondingly throughout and wherein.

DETAILED DESCRIPTION OF THE PREFERRED EMBODIMENTS

Figure 1:
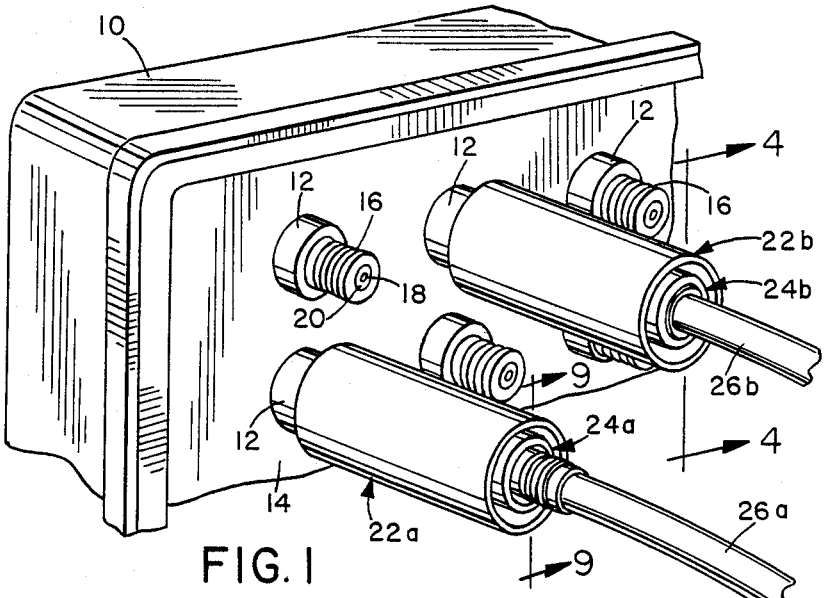
FIG. 1 is a perspective view of a portion of a multiple connector junction box or directional tap having two service cables connected thereto by the connector assembly of the present invention.

Referring now to FIG. 1, there is shown a cable television service junction box or directional tap 10 having its protective cover removed. A plurality of output ports 12 are rigidly mounted across a metal face plate 14 of directional tap 10. Each output port is typically configured as a female coaxial cable connector having an externally threaded cylindrical end portion 16. End portion 16 is typically in electrical contact with the ground sheath or outer conductive sheath of a coaxial feed or distribution cable (not shown) coupled to directional tap 10. The distribution cable includes an insulated center conductor which is electrically coupled to a center conductor socket 18 mounted within each end portion 16. Socket 18 is electrically insulated from end portion 16 by insulator 20.

As illustrated in FIG. 1, a pair of connector assemblies **22*a* and 22*b* are each coupled to selected output port to permit selective coupling of cable service to the user. Upon installation of cable service to the subscriber or customer, connector assembly 22 is fitted upon a selected output port 12. Thereafter, connector assembly 22 need not be removed to disconnect or reconnect cable service to the subscriber. Each connector assembly 22 is of a tamper-resistant construction, details of which are described herein. Installation of a connector assembly 22 or the connection or disconnection of cable service through the connector assembly is provided through a special tool, illustrated in FIG. 2**.

Connector assemblies 22 are illustrated as having a male mating or male coaxial cable connector **24*a* and its corresponding service cable 26*a* inserted into a connector assembly 22*a* in an "off" service position. Mating connector 24*b* and its corresponding service cable 26*b* is inserted into connector 22*b*** in an "on" service position.

Figure 2:
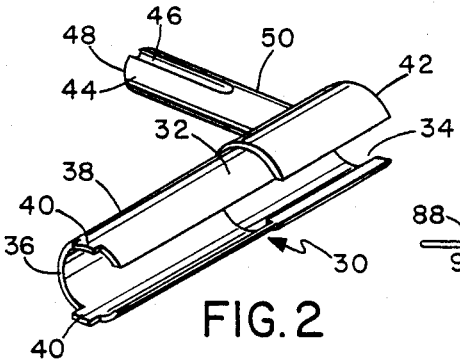
FIG. 2 is a perspective view of a special tool used with the connector assembly.

FIG. 2 illustrates tool 30 used in the installation of a connector assembly in the positioning of the mating connector within the connector assembly. Tool 30 comprises a metal tubular or generally hollow cylindrical body 32 having open ends and an axial wall section removed forming lengthwise opening 34. Body 32, therefore, has a C-shaped cross section. Opening 34 in body 32 permits the tool to be slipped around service cable 26 for engaging or disengaging mating connector 24 with the corresponding directional tap output port 12. One portion of body 32, adjacent end 36 defines a locking key, portion 38. At end 36 a pair of fingers 40 extend axially outwardly with respect to the axis of body 32. Mounted perpendicularly adjacent the other end, end 42, of body 30 is a metal cylindrical body 44. A pair of radially opposed axial grooves are formed lengthwise along body 44. Grooves 46 extend from end of body 44, end 48, away from body 32 along the length of body 44 towards body 32. The portion of body 44 including grooves 46 define an installation key portion 50 used in installing connector assembly 22 to a selected directional tap output port 12.

Figure 3:
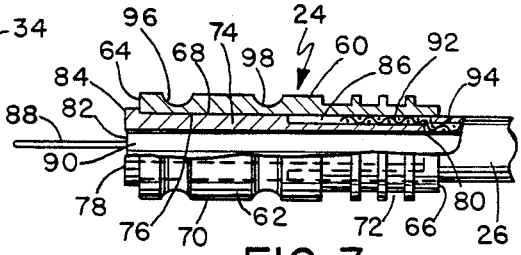
FIG. 3 is a side elevation view, partially cut away, of a male coaxial mating connector used with the connector assembly.

FIG. 3 illustrates mating connector 24 in a partially cut away view, as assembled upon the end of coaxial service cable 26. Mating connector 24 is formed from a tubular or generally hollow cylindrical metal body 60 having an outer surface 62; open ends 64 and 66; and a central axial throughbore which defines an inner surface or wall 68. The region adjacent end 64 is generally defined as a coupling portion 70 while the region adjacent end 66 is defined as a deformation portion 72. Body 60 at deformation portion 72 typically has a wall thickness less than that of coupling portion 68.

Mounted within body 60 is a tubular or generally hollow cylindrical metal body 74 having an outer surface 76, open ends 78 and 80; and a central axial throughbore which defines inner surface 82. End 78 has a flange 84 which abuts against the end face of end 64. The throughbore in body 60 is of a sufficiently large diameter such that a gap, gap 86, is formed between inner surface 68 of body 60 and the outer surface 76 of body 74.

When coaxial service cable 26 is inserted within connector 24, cable center conductor 88 and its surrounding central insulating layer 90 are positioned within the throughbore of body 74 with layer 90 abutting against inner surface 82. Center conductor extends outwardly beyond flange 82 and end 78. Cable 26 further includes a conductive sheath 92 surrounding central insulating layer 90 and an outer insulating layer 94 covering conductive sheath 92. Outer insulating layer 94 and conductive sheath 92 protrude into the gap between the inner surface of body 60 and the outer surface of body 74 whereby conductive sheath 92 is in electrical contact with body 60. Typically, deformation portion 72 is crimped by standard techniques so as to secure cable 26 within connector 24 and ensure electrical contact between conductive sheath 44 and connector 26.

In an alternative embodiment it is envisioned that body 74 may be eliminated from connector 24. In the alternative embodiment, cable 26 is inserted directly into the throughbore in body 60.

Body 60 further includes in coupling portion 70, a pair of annular grooves 96 and 98 circumferentially formed in body 60 and spaced apart from one another along outer surface 62. Groove 96 is positioned adjacent end 64 while groove 98 is positioned near a junction between coupling portion 70 and deformation portion 72.

Figure 5:
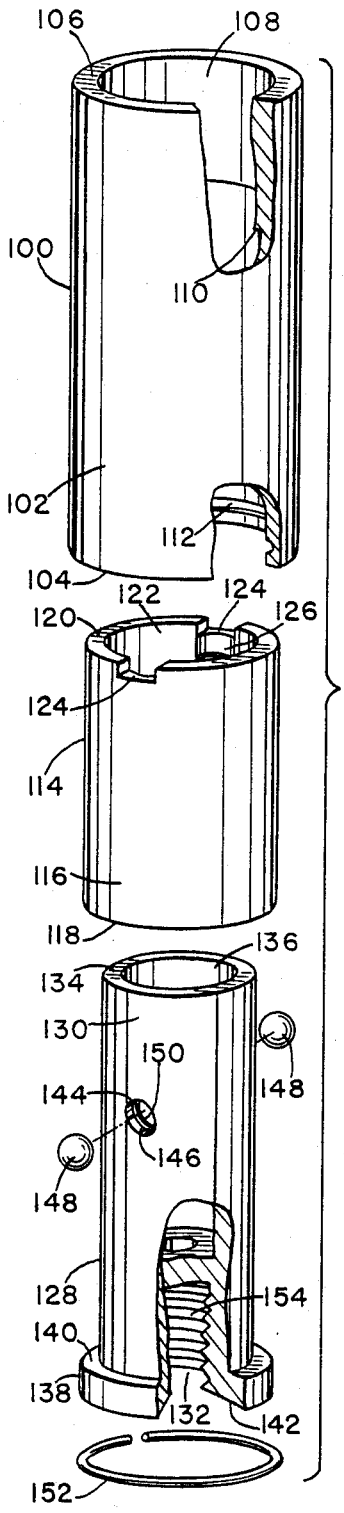
FIG. 5 is an exploded prospective view of the components of the connector assembly.

FIG. 5 illustrates, in an exploded prospective view, the major components of connector assembly 22. Connector assembly 22 includes a metal tubular or generally cylindrical hollow outer casing 100 having an outer surface 102; open ends 104 and 106, and a throughbore defining an inner surface 108. Adjacent end 106, the internal wall thickness of outer casing 100 is increased so as to form a shoulder 110 therein. Formed adjacent end 108 in inner surface 108 is an annular groove 112.

A plastic or metal, tubular or generally cylindrical hollow sleeve 114 having an outer surface 116, open ends 118 and 120, and a throughbore defining an inner surface 122, is formed having an outer diameter sufficient to enable positioning within the bore of outer casing 100 adjacent end 108. Sleeve 114 when positioned within outer casing 100 has end 120 which abuts against shoulder 110 to retain sleeve 114 within outer casing 100. Sleeve 114 has formed in inner surface 122 adjacent end 120 a pair of radially opposed notches 124 which extend axially along a portion of the length of sleeve 112 towards end 118. Sleeve 114 also includes a pair of opposed radially aligned axial grooves 126 formed in inner wall 122 adjacent end 120. Grooves 126 extend along a portion of the length of sleeve 114 towards end 118.

A metal tubular or generally cylindrical hollow inner casing 128 having an outer surface 130, open ends 132 and 134, and a throughbore defining an inner surface 136, is formed with an outer diameter to enable positioning within the bore of sleeve 114. Inner casing 128 has formed at end 132 flange 138 having a shoulder 140 for abutting against end 118 of sleeve 114. Furthermore, flange 140 includes an end face 142 opposite shoulder 140. Formed in inner casing 128, along the length thereof are a pair of radially aligned ball sockets 144. Ball sockets 144 are each comprised of a first hole 146, of a diameter slightly larger than the diameter of a ball which will be placed therein, drilled partially into inner casing 128 from the outer surface 130. A second hole 150, of a smaller diameter than hole 146, and aligned therewith, is drilled through inner casing 128 through to the interior. Bole 150 is of a smaller diameter to prevent ball 148 from completely passing through casing 128 into the interior, but permitting it to protrude into the interior.

With each ball 148 mounted in a respective ball socket 144, sleeve 144 slips over inner casing 128 abutting at end 118 with shoulder 140. Sleeve 114 also retains balls 148 within ball sockets 144.

The assembly of sleeve 114 and inner casing 128 is mounted within outer casing 100. End 120 of sleeve 114 abuts shoulder 110 of outer casing 100. A retaining ring 152 is positioned in groove 112 of outer housing 100 and abuts the end face of inner casing 128. In this arrangement, inner casing 128, sleeve 114, and outer casing 100 are each independently rotatable with respect to one another about a common axis. When inner casing 128 is positioned within sleeve 114, ball sockets 144 are located near end 120 of sleeve 114. The end of grooves 126 are in the radial plane defined by the edge of ball sockets 144, closest to end 132 of inner casing 128. By rotating sleeve 114 about the common axis such that grooves 126 are offset in alignment with ball sockets 144, balls 148 protrude past inner surface 136 into the hollow interior of inner casing 128. In this position, balls 148 are locked protruding into the hollow interior of casing 128. However, when sleeve 114 is rotated such that grooves 126 are in alignment with ball sockets 144, balls 148 are freed from protruding into the interior of inner casing 128.

Figure 4:
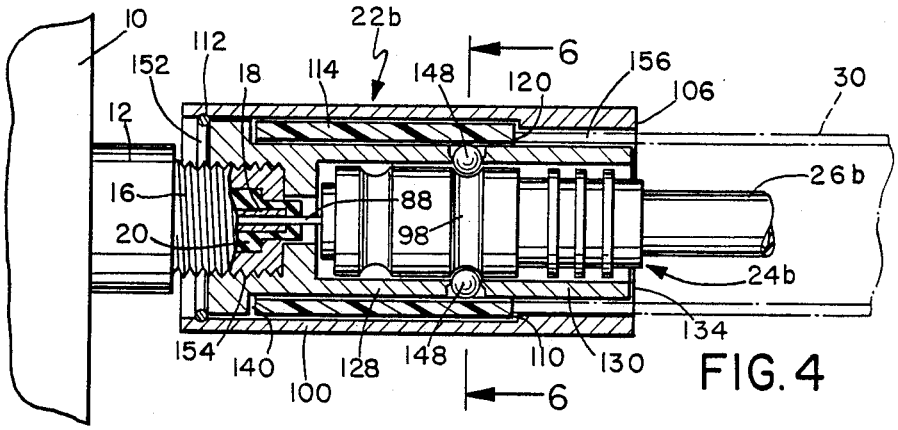
FIG. 4 is an enlarged sectional view taken along line 4—4 of FIG. 1.

FIG. 4 illustrates, in cross section, connector assembly 22b mounted upon output port 12. Connector assembly 22 is secured to the threaded end portion 16 of output port 12 by threads 154 formed internally in inner casing 128 at end 132.

In FIG. 4, and with further reference to FIG. 3, mating connector 24b is positioned within connector assembly 22b for electrical contact with center conductor 88, of service cable 26b, with center conductor socket 18 of output 12. With center conductor 88 received within center conductor socket 18, center conductor 88 is in electrical contact with center conductor socket 18 so that the signal fed to the directional tap may be transmitted from the output port through the connector to the subscriber's receiver such as a television set. The service cable sheath 92 is electrically connected to the ground shielding of the feed cable coupled to the directional tap 10 via body 60, balls 148, inner casing 128 and threaded end portion 16 of output port 12.

Figure 6:
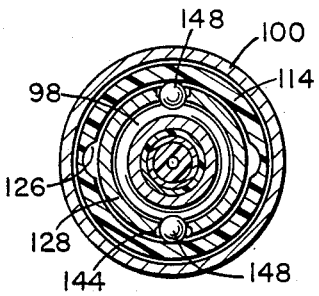
FIG. 6 is a sectional view taken on line 6—6 of FIG. 4, with the coaxial mating connector locked in place.

As illustrated in FIGS. 4 and 6, sleeve 114 is positioned with axial grooves 126 offset in alignment from ball sockets 144. Therefore, balls 148 are forced to protrude into the hollow interior of inner casing 128. As such, balls 148 engage groove 98 of mating connector 24b so as to lockingly engage mating connector 24b in a fixed relationship with inner casing 128. Although mating connector 24b is locked in a manner to prevent movement lengthwise in inner casing 128, it still may be rotated about the common center axis if necessary.

With inner casing 128 mounted upon output port 12, both sleeve 114 and outer casing 100 are independently rotatable with respect to one another. Therefore, outer casing 100 may be rotated without affecting the alignment of grooves 126 of sleeve 114 with respect to ball sockets 144. This independent rotation feature provides security from unauthorized tampering with service. Since outer casing 100 may be rotated by one attempting to tamper with the service connection, this rotation has no affect upon the positioning of mating connector 24b within inner casing 128. In addition, rotation of the outer casing has no effect on the coupling of the inner casing to the output port. Therefore, rotation of the outer casing will not enable the removal of the connector assembly from the output port.

To effect a change in service status, such as service discontinuance, one need merely change the relative position of mating connector 24b within connector assembly 22b with respect to output port 12. To change the service status, one would need to insert tool 30 of FIG. 2 with the locking key portion 38 positioned within gap 156 formed between inner surface 108 of outer casing 100 and outer surface 130 of inner casing 128 at the respective ends 106 and 134. Tool 30, as illustrated in dashed lines in FIG. 4, is inserted within gap 156 for rotating sleeve 114 so as to align grooves 126 with ball sockets 144.

Figure 8:
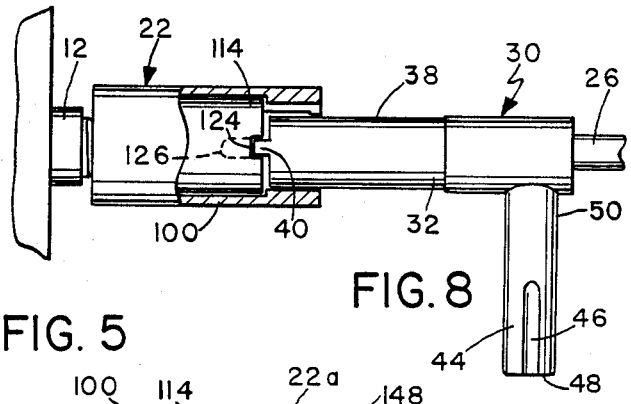
FIG. 8 is a side elevation view, partially cut away, showing the tool in use for locking or unlocking the connector assembly.

FIG. 8 illustrates tool 30 having locking key portion 38 inserted within gap 156 with fingers 40 engaged in notches 124. Rotation of tool 30 about the common axis between tool 30 and connector assembly 22 enables the alignment or offset in alignment of sleeve grooves 126 with the inner casing ball sockets.

Figure 7:
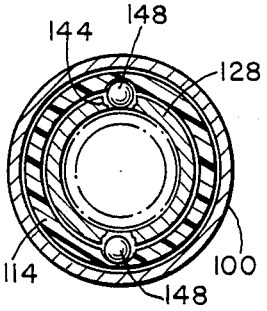
FIG. 7 is a view similar to FIG. 6, with the locking mechanism of the connector assembly released.

When the sleeve is rotated by the tool for alignment of the sleeve grooves with the inner casing ball sockets, the balls "float" within the region defined by the grooves and ball sockets to permit movement of a mating connector lengthwise in the inner casing. FIG. 7 illustrates the aligned positioning of grooves 126 with ball sockets 144. Balls 144 "float" within the region defined by an aligned ball socket and groove. In this position, balls 148 are not forced to protrude into the hollow interior of inner casing 128. Groove 126 is of a depth in sleeve 114 such that ball 48 does not fall completely out of ball socket 144 into groove 126.

Figure 9:
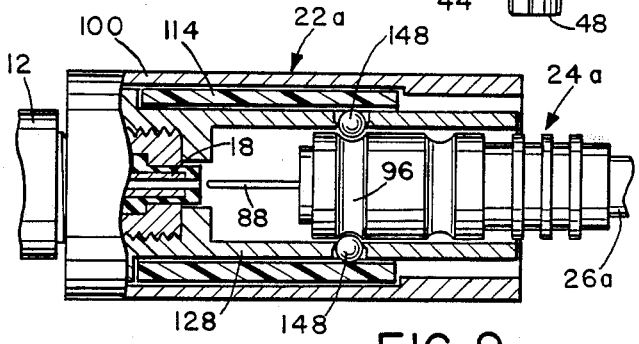
FIG. 9 is an enlarged sectional view taken along line 9—9 of FIG. 1.

FIG. 9 illustrates, in cross section, connector assembly 24a mounted upon output port 12 in a manner similar to that described with reference to FIG. 4. In FIG. 9, mating connector 24a is positioned with balls 148 engaging groove 96. Balls 148 are locked by sleeve 114 into engagement with groove 96 in a manner similar as described with reference to the locking of balls 148 against groove 98 in FIG. 4. Mating connector 24a, in the position illustrated in FIG. 9, results in center conductor 88 of service cable 26a being disengaged from center conductor socket 18 of output port 12. Therefore, center conductor 88 is electrically disconnected from center conductor socket 18, resulting in disconnection of service.

Figure 10:
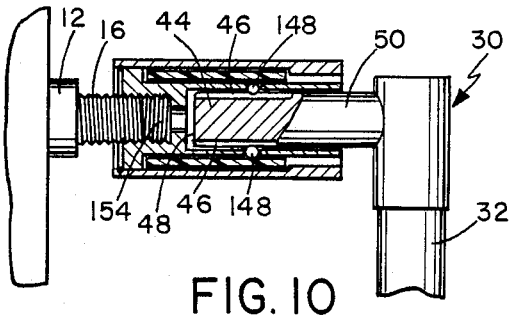
FIG. 10 is a sectional view of the connector assembly on a reduced scale showing the tool in use for attaching or removing the connector assembly from a directional tap output port.

FIG. 10 illustrates the technique in installing connector assembly 22 upon output port 12. In FIG. 10, tool 30 has installation key portion 50 inserted within the interior of inner casing 128. For installation of the connector assembly, the grooves in sleeve 114 must be offset in alignment with the ball sockets of inner casing 128. In this position, balls 148 are locked into protruding within the interior of inner casing 128. The tool is then inserted into the interior of casing 128 with grooves 146 of installation key portion engaged with balls 148. Upon rotation of tool 30 about a common axis formed by connector assembly 22 and installation key portion 50, balls 148 force rotation of inner casing 128 about the common axis. Rotation of inner casing 128 engages or disengages threads 154 with the threads on end portions 16 of output port 12 so as to "screw on" or "screw off" connector assembly 22 to/from output port 12.

The connector assembly of the present invention permits a mating connector to be retained in either an engaged or disengaged position for respective coupling or decoupling of cable service without removal of the mating connector from an output port. This feature enables connection or disconnection of cable service with the ease of a special tool. In addition, access to the connection or disconnection of service is restricted to one having a tool. Furthermore, the retention of mating connector within the connector assembly permits the realization of quick and easy connection and disconnection of service within a permanent, contaminant free housing.

The exemplary embodiment described herein illustrates one preferred embodiment of the invention. The previous description of the preferred embodiment of the invention is provided to enable any person skilled in the art to make or use the invention. Various modification to the exemplary embodiment will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and novel features disclosed herein.

What is claimed is:

1. An apparatus for providing selective electrical coupling between a pair of mating connectors comprising:

an outer casing;

an inner casing rotatably disposed about a common axis with said outer casing within said outer casing, said inner casing having means for attaching said inner casing to one of a pair of mating connectors;

a sleeve member rotatably disposed about said common axis between said outer and inner casings; and connector mating means for retaining the other one of said pair of mating connectors in a selected one of first and second positions within said inner casing, said other mating connector being engaged and disengaged from electrical contact with said one mating connector when respectively positioned in said first and second positions.

2. The apparatus of claim 1 wherein said connector mating means comprises:

at least one internal axial groove formed in said sleeve;

at least one ball socket formed in said inner casing;

at least one ball positioned within each ball socket; and wherein the other one of said mating coaxial connectors has at least two depressions formed spaced apart along its length such that when said axial groove is offset in alignment from said ball socket, said ball is engaged within one of said depressions.

3. The apparatus of claim 1 wherein said connector mating means comprises:

a pair of radially opposed axially grooves formed in said sleeve;

a pair of radially opposed ball sockets formed in said inner casing;

a ball positioned within each ball socket; and wherein the other one of said mating connectors has at least two annular grooves formed spaced apart along its length such that when each annular groove is offset in alignment from a corresponding ball socket, each ball is engaged within one of said annular grooves.

4. The apparatus of claim 1 further comprising said other one of said mating connectors, said other one of said mating connectors comprising an elongated body having a throughbore with said body having means cooperating with said connector mating means for retaining said other one of said mating connectors within the selected one of said first and second positioning.

5. The apparatus of claim 1 further comprising retaining means for retaining said sleeve member and said inner casing within said outer casing for rotation about said common axis.

6. The apparatus of claim 5 wherein said retaining means comprises:

a groove formed inside said outer casing adjacent one end of said outer casing and a shoulder formed inside said outer casing adjacent an other end of said outer casing;

a retaining ring mounted in said groove;

a flange formed adjacent an end of said inner casing, said flange having an end faceplate abutting said retaining rings; and wherein one end of said sleeve abuts said flange and an other end of said sleeve abuts said shoulder with a gap formed between said outer casing and said inner casing in a region adjacent said shoulder, said gap extending along the length of said outer casing to said outer casing other end.

7. The apparatus of claim 1 wherein said sleeve further comprises tool engagement means for engaging a tool for rotation of said sleeve.

8. The apparatus of claim 7 wherein said tool engagement means comprises a pair of opposed axial notches formed in said other end of said sleeve.

9. The apparatus of claim 1 wherein said inner casing attaching means comprises internal threads formed within said inner casing adjacent one end for engaging said one of said mating connectors having external threads.

10. The apparatus of claim 9 further comprising retaining means for retaining said sleeve member and said inner casing within said outer casing for rotation about said common axis, said retaining means comprising:

a groove formed inside said outer casing adjacent one end of said outer casing and a shoulder formed inside said outer casing adjacent other end;

a retaining ring mounted in said groove;

a flange formed adjacent end of said inner casing, said flange having an end faceplate abutting said retaining ring; and wherein one end of said sleeve abuts said flange at the other end of said sleeve abuts said shoulder with a gap formed between said outer casing and said inner casing in a region adjacent said shoulder, said gap extending along the length of said outer casing to said outer casing other end.

11. The apparatus of claim 10 wherein said connector mating means comprises:

at least one internal axial groove formed in said sleeve;

at least one ball socket formed in said inner casing;

at least one ball positioned within each ball socket; and wherein the other one of said mating connectors has at least two depressions formed spaced apart along its length such that when said axial groove is offset in alignment from said ball socket, said ball is engaged within one of said depressions.

12. The apparatus of claim wherein said connector mating means comprises:

a pair of radially opposed axially grooves formed in said sleeve;

a pair of radially opposed ball sockets formed in said inner casing;

a ball positioned within each ball socket; and wherein the other one of said mating coaxial connectors has at least two annular grooves formed spaced apart along its length such that when each annular groove is offset in alignment from a corresponding ball socket, each ball is engaged within one of said annular grooves.

13. The apparatus of claim 10 wherein said sleeve further comprises tool engagement means for engaging a tool for rotation of said sleeve.

14. A connector assembly for providing selective electrical coupling to an externally threaded female coaxial connector having a center conductor socket, comprising:

a hollow cylindrical outer casing having an inner annular groove adjacent one end and an inner shoulder adjacent the other end;

a hollow cylindrical sleeve rotatably disposed about a common axis with said outer casing within said outer casing, said sleeve having one end with a pair of radially opposed inner axial grooves with said sleeve one end engaging said outer casing shoulder;

a hollow cylindrical inner casing rotatably disposed about said common axis within said sleeve, said inner casing having a flange with an endface formed at one end, said inner casing internally threaded at said one end for engaging an externally threaded female coaxial connector, said sleeve other end engaging said flange and said inner casing having a pair of opposed ball sockets formed therein;

a pair of balls each mounted within a respective one of said ball sockets;

a retaining ring mounted within said outer casing groove and engaging said flange endface; and a hollow cylindrical coupling casing having a pair of spaced apart outer annular grooves, said coupling casing for receiving a coaxial cable through one end of said coupling casing with the cable having a center conductor extending beyond the other end of said coupling casing and said balls for lockingly engaging a selected one of said coupling casing grooves when said sleeve axial grooves are offset in alignment with said ball sockets and releasing said balls from engagement with a selected one of said coupling casing grooves when said sleeve axial grooves are aligned with said ball sockets

15. The connector assembly of claim 14 wherein said sleeve further comprises a pair of notches formed in said sleeve at said sleeve one end, said notches for receiving a tool means, in a gap formed between said outer casing and said inner casing, for engaging said slots for rotation of said sleeve.

16. The connector assembly of claim 14 wherein in said coupling casing, one of said outer annular grooves is adjacent said coupling casing one end and the other one of said outer annular grooves is adjacent said coupling casing other end, and wherein said balls lockingly engage said one outer annular groove, said coaxial cable center conductor is disengaged from a female coaxial connector center conductor socket and when said balls lockingly engage said other outer annular groove said coaxial cable center conductor is engaged in a female coaxial connector center conductor socket.

17. The connector assembly of claim 16 wherein said sleeve further comprises a pair of notches formed in said sleeve at said sleeve one end, said notches for receiving a tool means, in a gap formed between said outer casing and said inner casing, for engaging said slots for rotation of said sleeve.

18. The connector assembly of claim 17 wherein each of said notches is aligned with a corresponding axial groove in said sleeve.

19. A male coaxial connector adapted for selective electrical coupling to a female coaxial connector in a connector assembly coupled to the female coaxial connector, comprising, an elongated generally cylindrical body having a throughbore for receiving from one end a coaxial cable therein, said body having a pair of spaced-apart outer annular grooves formed along the length thereof adjacent the other end, said grooves for engaging said connector assembly.

20. The connector of claim 19 wherein said body has a coupling portion adjacent one end and a deformation portion adjacent the other end, said grooves formed within said coupling portion and the body wall thickness of said deformation portion is less than the body wall thickness of said coupling portion.

21. The connector of claim 19 further comprising an additional generally cylindrical body having a throughbore and a flange formed at one end, said additional body mounted about a common axis with said body within said body with said flange abutting against one end of said body, said additional body is of a smaller diameter than said body throughbore so as to form a gap between said body throughbore and said additional body.

22. The connector of claim 21 wherein a coaxial cable, having an inner conductor surrounded by an outer conductive sheath and separated therebetween by an inner insulating layer and an outer insulating layer covering said outer conductive sheath, is received at an other end of said body with said outer insulating layer and outer conductive sheath positioned within said gap and said inner conductor and inner insulating layer positioned within said additional body throughbore with said inner conductor extending outwardly from said inner additional body beyond said flange.

23. An assembly for providing selective electrical coupling between a pair of mating connectors, comprising:

a casing;

receiver means disposed within said casing for coupling said casing to one mating connector of a pair of mating connectors and for receiving an other one of said pair of mating connectors; and engagement means disposed within said casing and cooperating with said receiver means for retaining said other mating connector in a selected one of a first and second position within said casing, said other mating connector being electrically engaged and disengaged from said one mating connector when respectively positioned in said first and second positions.

* * * * *